US006925683B2

(12) United States Patent
Zebedee

(10) Patent No.: US 6,925,683 B2
(45) Date of Patent: Aug. 9, 2005

(54) HINGE

(76) Inventor: Alan R Zebedee, Forest Lodge, Walldown Road, Whitehill, Hants (GB), GU35 9AA ( * ) Notice: Subject to any disclaimer, the term of this patent is extended or adjusted under 35 U.S.C. 154(b) by 26 days.

(21) Appl. No.: 10/649,861

(22) Filed: Aug. 28, 2003

(65) Prior Publication Data

US 2004/0040116 A1 Mar. 4, 2004

(30) Foreign Application Priority Data

Sep. 2, 2002 (GB) ..... 0220320

(51) Int. Cl.[7] ..... E05D 7/04

(52) U.S. Cl. ..... 16/243; 16/235; 16/247; 16/271; 16/265; 16/381

(58) Field of Search ..... 16/243, 235, 247, 16/248, 384, 387, 388, 381, 271, 272, 260, 267, 265; 49/193–195, 382, 381, 383; 52/204.1

(56) References Cited

U.S. PATENT DOCUMENTS

| | | | | | |
|---|---|---|---|---|---|
| 3,754,136 | A | * | 8/1973 | Osteen | 362/368 |
| 4,185,357 | A | | 1/1980 | Busse | |
| 4,286,352 | A | * | 9/1981 | Pittasch | 16/237 |
| 4,293,976 | A | * | 10/1981 | Pittasch et al. | 16/245 |
| 4,304,027 | A | | 12/1981 | Di Fazio | |
| 4,381,580 | A | * | 5/1983 | Hellstrom et al. | 16/243 |
| 4,603,452 | A | * | 8/1986 | Paciorek | 16/262 |
| 4,656,691 | A | * | 4/1987 | Allen | 16/251 |
| 4,748,717 | A | * | 6/1988 | Osborne | 16/240 |
| 4,785,498 | A | * | 11/1988 | Brotschi | 16/238 |
| 5,001,863 | A | * | 3/1991 | Uppstrom | 49/399 |
| 5,031,275 | A | * | 7/1991 | Chiang | 16/263 |
| 5,201,097 | A | * | 4/1993 | Phillips | 16/248 |
| 5,423,106 | A | * | 6/1995 | Peyret | 16/260 |
| 5,669,105 | A | * | 9/1997 | Depke | 16/245 |
| 5,799,370 | A | * | 9/1998 | Davidian et al. | 16/236 |
| 5,822,832 | A | * | 10/1998 | Maggi | 16/276 |
| 6,152,554 | A | | 11/2000 | Parisi | |
| 6,276,025 | B1 | * | 8/2001 | Leibman | 16/241 |
| 6,493,905 | B2 | * | 12/2002 | Stettler | 16/271 |

FOREIGN PATENT DOCUMENTS

| | | | | | |
|---|---|---|---|---|---|
| CH | 656178 | A | * | 6/1986 | E05D/7/04 |
| DE | 2339623 | | | 2/1975 | |
| EP | 259618 | A | * | 3/1988 | E05D/5/02 |
| EP | 1223276 | A2 | | 1/2002 | |
| FR | 2275622 | A | * | 2/1976 | E05D/7/04 |
| FR | 2345574 | A | * | 11/1977 | E05D/7/00 |
| FR | 2412237 | | | 7/1979 | |
| FR | 2763985 | A1 | * | 12/1998 | E05D/7/04 |
| FR | 2845722 | A1 | * | 4/2004 | E05D/7/04 |
| GB | 2084240 | A | * | 4/1982 | E05D/7/04 |
| GB | 2160257 | A | | 12/1985 | |
| GB | 2276200 | A | | 9/1994 | |
| GB | 2359114 | A | | 8/2001 | |

* cited by examiner

*Primary Examiner*—Chuck Mah
(74) *Attorney, Agent, or Firm*—Manelli Denison & Selter; Edward J. Stemberger

(57) ABSTRACT

A hinge comprises two elements, respectively attachable to first and second structures, and hingedly rotatable about an axis relative to each other. One said element comprises a first elongate member extending along the direction of the said axis and having a keyway slot that extends part way along the said member from one end thereof, and also comprises a second member adapted for attachment to one of the said structures and integrally formed with a key member receivable in the slot. The keyway slot and the key member are formed with profiles that enable the key member to be received in the slot to a selected one of a plurality of depths, thereby enabling adjustment in the spacing of the said one structure radially of the said axis.

15 Claims, 3 Drawing Sheets

8
7
11

9
10
10
10
8
11
9
9
7

15
13
14

16
14
15
13

14
15
13
7

3
6

3
6
11

7
2
II
II
16
1
15
14
A 12
6
3
2
5
4

25
22
34
107
111
31
28
103
29
102
27
30

33
32
34
107
103
31
102
30
111
28
27
29

HINGE

BACKGROUND

This invention relates to hinges.

The conventional practice for hanging internal doors in a building is to form a rebate in the door frame and in a corresponding side edge of the door for respective hinge plates rotatable relative to each other about an axis defined for the hinge. When correctly positioned, the closed door abuts against respective stop panels fixed to the side jambs of the door frame and to the lintel of the door frame. To do this properly requires a skilled carpenter. Should any adjustment in the positioning of the door in its frame prove necessary, either an additional rebate must be formed or packing inserted. Time is of the essence in modern house-building practice. As a result, movement frequently arises as a consequence of the building drying out over a period time and often after initial occupation has taken place. As a consequence, the internal doors of the house may often require adjustment. The nature of the adjustment necessary is not one that would be easy for a householder to carry out himself.

SUMMARY OF THE INVENTION

As explained in more detail below, the present invention provides a new form of hinge that includes a provision for adjustment.

In general, in one aspect, the invention provides a hinge comprising two elements, respectively attachable to first and second structures, and hingedly rotatable about an axis relative to each other; one said element comprising a first elongate member extending along the direction of the said axis and having a keyway slot that extends part way along the said member from one end thereof, and a second member adapted for attachment to one of the said structures and integrally formed with a key member receivable in the slot, the keyway slot and the key member being formed with profiles that enable the key member to be received in the slot to a selected one of a plurality of depths, thereby enabling adjustment in the spacing of the said one structure radially of the said axis.

The key member and the first elongate member may be provided with means serving as stops to define greatest and least permitted limits of depth for the key member to be received within the keyway slot.

The second element may comprise a second elongate member extending along the direction of the axis and having an opening extending at least part way along the second elongate member from one end thereof The first elongate member is suitably formed of two sections, one of greater cross-section than the other, the smaller section being inserted into and rotatable about the said axis within the opening in the second elongate member, and the section of larger cross-section having the keyway slot formed therein. Preferably, though not necessarily, the two sections are cylindrical. The land formed where the larger and smaller sections join confronts the one end of the second member, optionally with an intervening washer and/or a spacer enabling adjustment in the position of the one structure relative to the other along the direction of the axis.

The confronting surfaces of the land and of the one end of the second member or of a spacer therebetween may be shaped so that the hinge acts as a rising butt.

The second element may additionally comprise a threaded member extending radially of the axis and adapted for threaded attachment to the other of the two structures. The threaded member is preferably externally threaded, and the selected depth to which the threaded member is inserted into the other structure enables adjustment of the position of the other structure radially of the said axis. Alternatively, the threaded member may be internally threaded, and the other structure provided with a co-operating externally threaded member, the selected depth to which that externally threaded member is inserted into the internally threaded member providing a similar adjustment.

When applied to an internal door fitting within a door frame, the three different adjustments referred to above may respectively provide for horizontal adjustment of the door across the door opening, vertical adjustment of the door within the frame, and horizontal adjustment of the door as a whole into or out of the door frame.

In general, in another aspect, the invention provides a door hung in a doorway by at least one hinge, the hinge comprising first and second elements, respectively attached to the door and to the doorway, the first and second elements being coupled together so as to be hingedly rotatable about a generally vertical hinge axis relative to each other; the first said element comprising a first elongate member extending along the direction of the hinge axis and defining a keyway slot therein that extends part way along the said member from one end thereof, and a second member attached to the door and integrally formed with a key member receivable in the slot, the keyway slot and the key member being formed with profiles that enable the key member to be received in the slot to a selected one of a plurality of depths, thereby enabling adjustment in the spacing of the door radially of the said axis, whereby the position of the door is adjustable across the doorway by selecting said depth.

In preferred embodiments, the second element of the hinge comprises a second elongate member extending along the direction of the hinge axis, and having a first end and a second end, the second elongate member defining an opening extending at least part way along the said second elongate member from said first end; the first elongate member is formed with a first generally cylindrical section and with a second section, the said first section being inserted into the opening in the second member to couple the first member and the second member together to form the hinge, and being rotatable about the hinge axis within the said opening, and the second section of the first elongate member being larger in cross-section than the diameter of the first said section to define a land between the first and second sections, the second section having the keyway slot formed therein; and a number, selected from zero, one and a plurality, of spacing elements selected from spacers and washers is inserted between the said land and the confronting first end of the second elongate member to adjust the height of the door within the doorway along the hinge axis.

In preferred embodiments, the second element comprises a threaded member extending radially of the axis, the hinge being attached to the doorway by said threaded member, whereby the position of the door as a whole relative to the doorway may be adjusted horizontally into and out of the doorway by adjusting the depth of threaded attachment between the threaded member and the doorway.

DESCRIPTION OF PREFERRED EMBODIMENTS

The embodiment of hinge 1 illustrated in FIGS. 1 to 9 of the present drawings comprises, as do all hinges, two elements which are respectively attachable to first and second structures and hingedly rotatable about an axis relative to each other.

Figures 1, 2, 3, 4, 5, 6, 7, 8, 9:
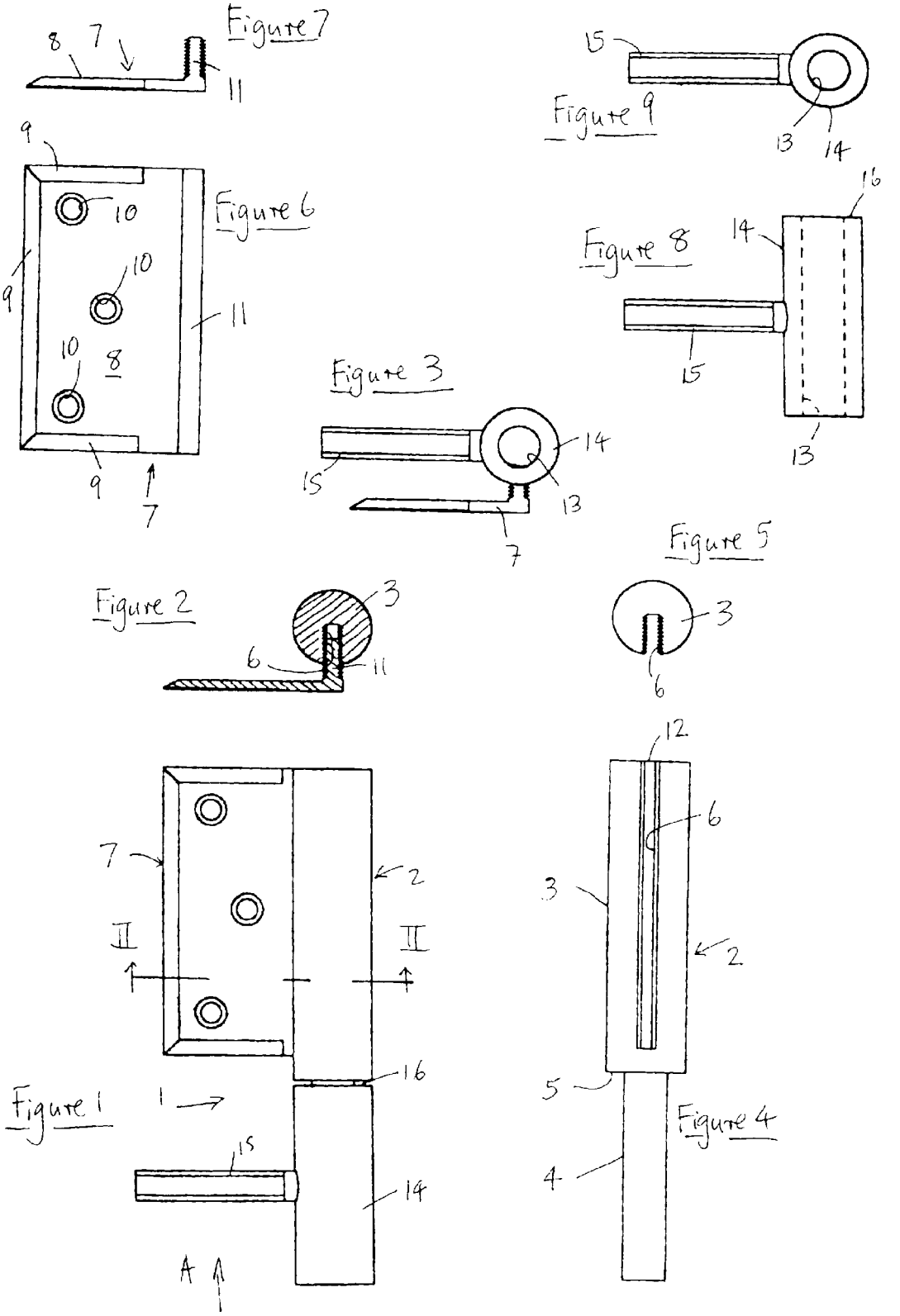
FIG. 1 shows a side elevational view of an embodiment of hinge constructed in accordance with the present invention.
FIG. 2 is a sectional view taken along the line II—II in FIG. 1.
FIG. 3 is an underneath plan view of the hinge of FIGS. 1 and 2 as seen in the direction of the arrow A in FIG. 1.
FIGS. 4 and 5 are respectively side and end elevational views of a first elongate member showing a keyway slot therein.
FIGS. 6 and 7 are respectively side and end elevational views of a hinge plate member adapted to inter-fit with the elongate member of FIGS. 4 and 5 to make a first element of the hinge.
FIGS. 8 and 9 are respectively side and end elevational views of a second element of the hinge.

In the present embodiment, a first of these elements comprises an elongate member 2, best shown in FIG. 4, which in this case comprises two generally cylindrical sections 3 and 4 with a land 5 where the two sections join. It will be appreciated that these sections need not be cylindrical, provided that one is of larger cross-section than the other, whereby a land is defined at the join between the two sections. The section 3 with the larger cross-section is formed with an elongate keyway slot 6, best shown in the sectional view of FIG. 5. Hinge plate 7, shown in FIGS. 6 and 7, inter-fits with the elongate member of FIGS. 4 and 5 to form the first element of the hinge.

Hinge plate 7 comprises a plate proper 8 formed with bevelled edges 9 and having counter-sunk through openings 10 for receiving counter-sunk screws to attach plate 8, for example, to a door, as explained in more detail below. Hinge plate 7 is integrally formed with a key member 11, the profile of which corresponds to the profile of keyway slot 6 so that it may be received therein from open end 12 of slot 6.

Keyway slot 6 and key member 11 are formed with profiles that enable the key member 11 to be received in the slot 6 to a selected one of a plurality of depths, as best shown in the sectional view of FIG. 2. This can readily be achieved by providing both the keyway slot and the key member with a repeating profile. By selecting which of the repeats on the key member keys with which of the repeats in the slot will then adjust the depth of the key member in the keyway slot.

Smaller diameter section 4 of elongate member 2 serves as a hinge pin and is received within opening 13 of an elongate member 14, conveniently cylindrical in form, as here, though not necessarily so, and which forms the second element of the hinge.

To enable element 14 to be attached, for example, to a door frame, it is provided with a threaded member 15, which may be a bolt or a wood screw simply attached to the cylindrical member 14, and extending radially from the axis defined by the opening 13.

Land 5 confronts end face 16 of cylindrical member 14 when the two elements of the hinge are assembled. In this embodiment both land 5 and surface 16 are shown flat. However, they could be profiled so that the hinge will act as a rising butt. For ease of illustration, the two surfaces 5 and 16 are shown slightly separated in FIG. 1. Because the individual elements of the hinge, including the two members which together form the first element of the hinge, lend themselves to being formed as simple die-cast mouldings and so do not have machined surfaces, in practice a thin silicone or nylon washer (not illustrated) is suitably inter-fitted between the surfaces 5 and 16. Alternatively, or additionally, spacers inserted between the surfaces 5 and 16 will have the effect of translating the first element of the hinge along the axis of the hinge relative to the second element. Thus, when the hinge is used to hang a door in a doorway, the introduction of spacers will raise the door vertically on its hinge relative to the door frame as explained further with reference to FIG. 10 below.

Although the utility for hinges constructed in accordance with the present invention is not restricted to the hanging of internal doors within a building, this is the scenario in which the invention was developed. It should be understood, however, that in referring herein to first and second structures to be hingedly related to each other by use of the hinge, these structures could be virtually anything. Examples would include a vehicle and an opening therein such as a vehicle door, a vehicle window, a hatchback, a vehicle boot, a vehicle trunk, a vehicle hatch, a vehicle bonnet or a vehicle roof opening. Further examples include a generally box-shaped member such as a box, a cabinet, including a wardrobe or a kitchen cabinet, a refrigerator and a case, including an attache case, in each case coupled with an associated lid or door.

Figure 10:
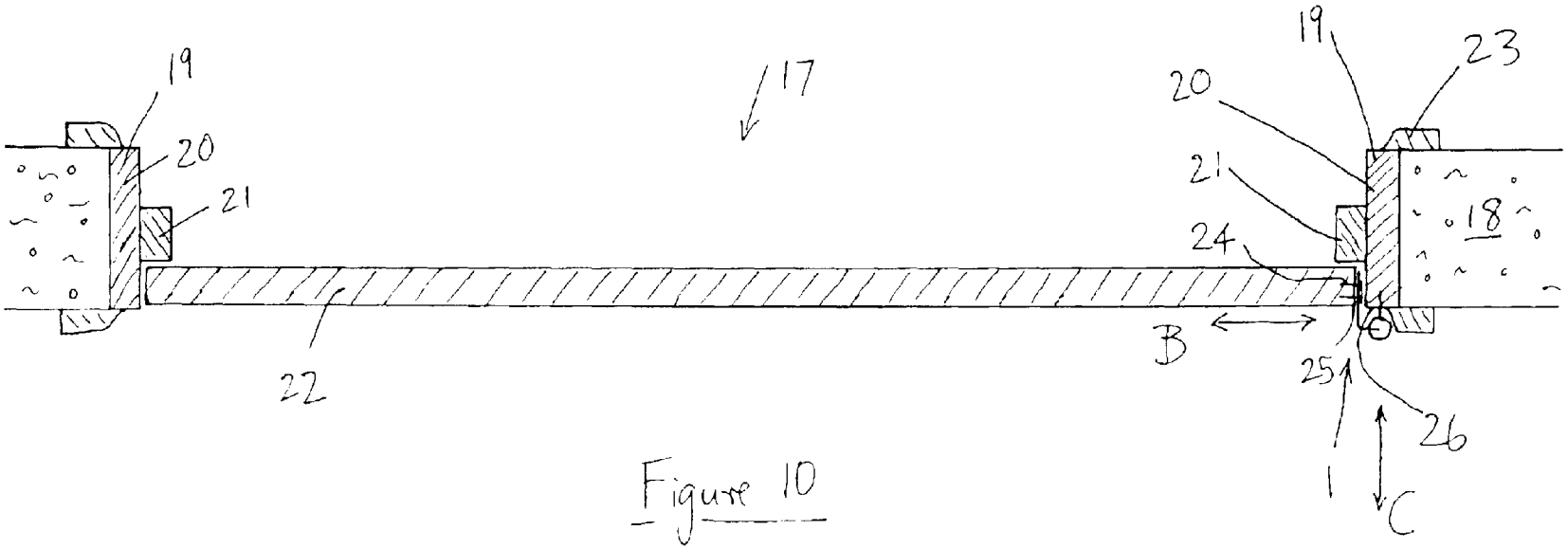
FIG. 10 is a generally schematic sectional view through a door mounted by a hinge as shown in FIGS. 1 to 9 in a doorway.

Referring to FIG. 10, which shows generally schematically how an embodiment of hinge as described in detail above may be used to hang a door and, in particular, explains the various adjustments inherent in the construction of the hinge:

An opening 17 in a wall 18 is lined by a door frame 19 including generally vertical jambs 20 with a lintel (not shown) over the top. The position of the door is marked by generally vertically mounted door stops 21 against which the door 22 closes. The door is hingedly mounted to one of the jambs, in this case that at the right of the drawing and vertically mounted mouldings 23 cover the join between the door jamb 19 and the wall 18. As shown in this view, a hinge 1 as described more particularly hereinabove is shown mounting the door to the door frame. It will be appreciated that there may be a plurality of hinges (preferably two) mounting the door to the doorway.

As shown, hinge plate 7 is fixed by means of screws 24 to side edge 25 of the door 22 and its key member is then guided into the keyway slot 6 (not shown in this Figure) of elongate member 2. The fit between the key member and the keyway slot should suitably be sufficiently tight that after insertion of the key member into the keyway slot, elongate member 2 does not simply fall away from the hinge plate member 7. Separately, threaded member 15 of cylindrical member 14 is screwed into side edge 26 of door jamb 20. This operation is then repeated for the second hinge. The door can then simply be mounted in position by lowering the respective pins 4 (not shown in this Figure) into openings 13 (also not shown in this Figure).

The vertical position of the door can readily be adjusted by inserting or removing spacers between elongate member 2 and cylindrical member 14. Adjustment in the position of the door width-wise across the doorway opening 17 in the direction of arrows B in FIG. 10 can be readily achieved by selecting the depth to which the key members are inserted into the keyway slots. Similarly, adjustment in the position of the door into or out of the door frame in the direction of arrows C in FIG. 10 is readily achieved by adjusting the extent to which threaded member 15 is inserted into door jamb 20. Thus, the positioning of the door in all three relevant directions is readily adjustable by means of adjusting the hinge alone. There is no need to make any rebates in mounting the hinge and therefore no need to adjust the positioning of the rebate or its depth in order to adjust the way in which the door is hung in the frame. Accordingly, as shrinkage or drying out occurs following the initial construction of a building or after the initial mounting of the door, the correct positioning of the door for operation within the doorway can readily be adjusted by the householder himself simply by making whichever of the necessary adjustments are required, as described above. No tools are actually needed to carry out the adjustments.

The individual elements of the hinge lend themselves to simple die-cast moulding manufacturing techniques so that the hinge is relatively inexpensive to manufacture. Those parts that are visible in use (the outer surface of the larger diameter portion 3 of elongate member 2, the outer surface of cylindrical member 14 and the bevel edge side of hinge plate 7) may be given a decorative finish, for example a brass finish. Because key member 11 of hinge plate 7 can be fitted into the keyway slot either way up, a single set of parts consisting of the hinge plate 7, cylindrical member 14 and elongate member 2 can be sold for both left hand and right hand use.

OTHER EMBODIMENTS

Figures 11, 12:
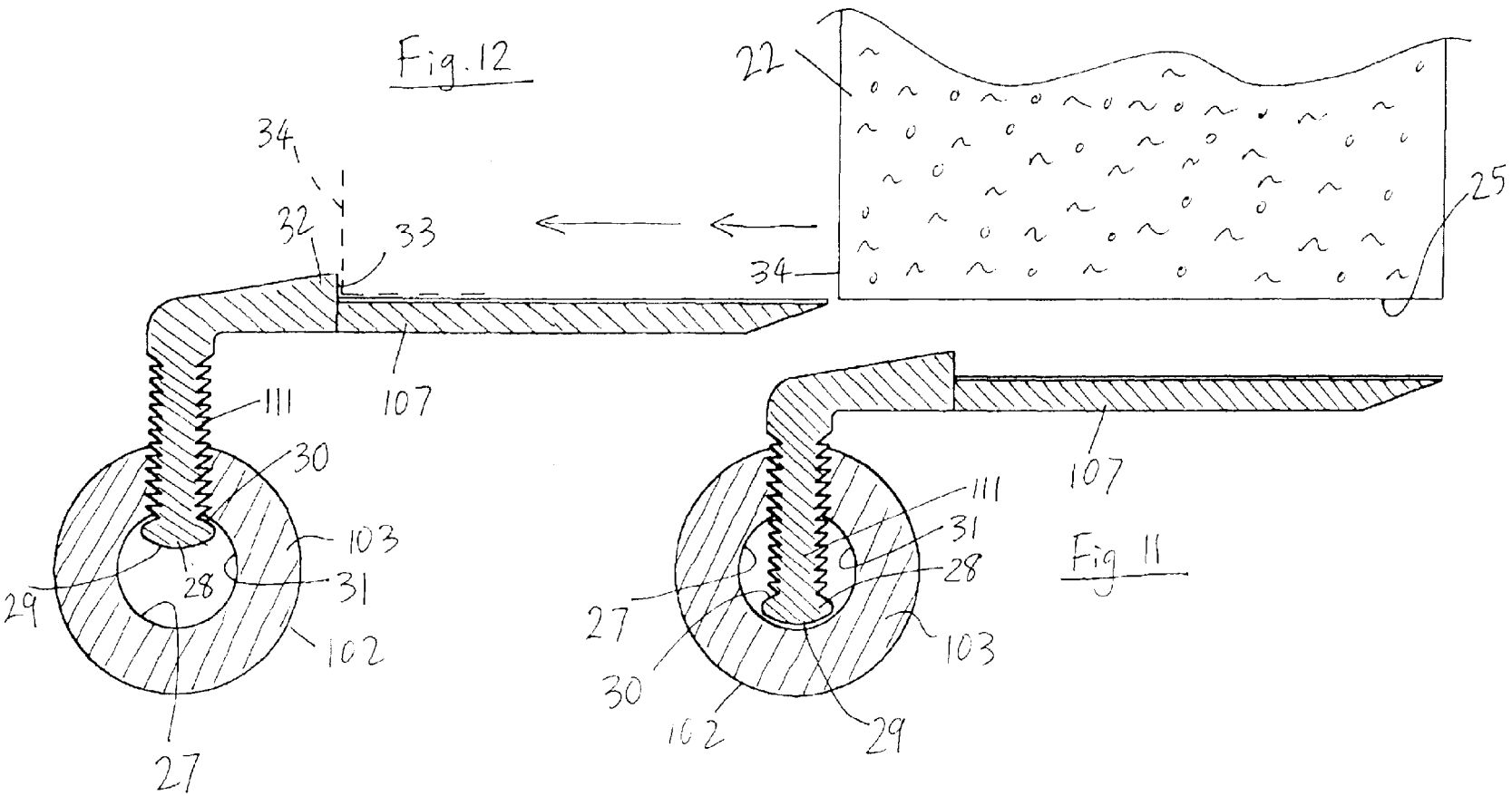
FIGS. 11 and 12 are sectional views on an enlarged scale corresponding to the view of FIG. 2 for an alternative embodiment.

FIGS. 11 and 12 show an alternative embodiment of the first element of the hinge comprising elongate member 102 and hinge plate 107. In this embodiment, elongate member 102 and hinge plate 107 are provided with respective stops designed to assist an inexperienced householder or "do-it-yourself" enthusiast to correctly locate elongate member 102 and hinge plate 107 relative to each other, and hinge plate 107 relative to a door. The second element of the hinge and parts of the first element not visible in the sectional views of FIGS. 11 and 12 may be the same as for the embodiment described with reference to FIGS. 1 to 9 above.

As can be seen from FIGS. 11 and 12, cylindrical section 103 of elongate member 102 has a central axial opening 27 into which keyway slot 106 opens. Key member 111 of hinge plate 107 is provided with an enlarged head 28 at its distal end. Head 28 is arcuately curved on its outer side 29 and on its underside 30 to correspond generally with the curve of internal surface 31 of opening 27. Thus in one extreme position (FIG. 11) allowed for key member 111 in keyway slot 106, outer side 29 of head 28 abuts internal surface 31, while in the other extreme position allowed for key member 111 in keyway slot 106, as shown in FIG. 12, the underside 30 of head 28 abuts internal surface 31. Positions beyond the extreme allowed position of FIG. 11 would provide too much strain on the key member with a danger that it might snap or inadvertently come free from the keyway; while positions beyond the extreme allowed position of FIG. 12 are likely to result in interference between a door, a doorway in which it is hung and the hinge. All positions between the two allowed extremes are permitted, giving a useful range of adjustment.

Hinge plate 107 is provided with a shoulder 32 with a butting surface 33 which will extend vertically when the hinge is used to hang a door. This butting surface serves as a stop to enable correct location of a vertical edge 34 of a door 22. Edge 34 is simply butted against surface 33 of shoulder 32 as shown in FIG. 12 to correctly locate the hinge plate relative to the door for insertion of screws (not shown) through the hinge plate, as described above.

Other variations and modifications of the hinges described in detail above will readily occur to persons of ordinary skill in this field in the light of the above description. It is my intention to cover all such modifications and variations within the scope and spirit of this invention as defined by the following claims.

What is claimed is:

1. A hinge comprising first and second elements, respectively attachable to first and second structures, and arranged to be coupled together so as to be hingedly rotatable about an axis relative to each other;

the first said element comprising a first elongate member extending along the direction of the said axis and defining a keyway slot in said first elongate member that extends part way along the said member from one end thereof, and a second member adapted for attachment to said first structure and integrally formed with a key member receivable in the slot, the keyway slot and the key member being formed with profiles that enable the key member to be received in the slot to a selected one of a plurality of depths, thereby enabling adjustment in the spacing of the said one structure radially of the said axis.

2. A hinge according to claim 1, wherein the second element comprises a second elongate member extending along the direction of the axis when the first and second elements are coupled together, and having a first end and a second end;

the second elongate member defining an opening extending at least part way along the said second elongate member from the said first end of the second elongate member.

3. A hinge according to claim 2, wherein the first elongate member is formed with a first generally cylindrical section and with a second section, the said first section being insertable into the opening in the second member to couple the first member and the second member together to form said hinge, the said first section being rotatable about the said axis within the said opening to provide for relative rotation of the first element hingedly relative to the second element, the second section of the first elongate member being larger in cross-section than the diameter of the first said section to define a land between the first and second sections, and the second section having the keyway slot formed therein.

4. A hinge according to claim 3, wherein the first element is coupled to the second element with the first section of the first elongate member inserted into the opening in the second member, and wherein a number, selected from zero, one and a plurality, of spacing elements selected from spacers and washers is inserted between the said land and the confronting first end of the second elongate member to adjust the relative position of the first and second members along the said axis.

5. A hinge according to claim 3, wherein the first element is coupled to the second element with the first section of the first elongate member inserted into the opening in the second member, and wherein the land and one of the confronting first end of the second elongate member and an optional spacer between the land and the said first end are shaped so that the hinge acts as a rising butt.

6. A hinge according to claim 1, wherein the second element comprises a threaded member extending radially of the axis and adapted for threaded attachment to said second structure.

7. A hinge according to claim 1, wherein the key member and the first elongate member are provided with means serving as stops to define greatest and least permitted limits of depth for the key member to be received within the keyway slot.

8. A first structure mounted to a second structure for hinged movement relative thereto, the first structure being coupled to the second structure by at least one hinge according to claim 1.

9. First and second structures according to claim 8, wherein the second structure defines an opening lying substantially in a plane, wherein the first structure defines means adapted for optional closure of said opening by rotation of said first structure about the axis defined by said hinge(s), and wherein the selected depth by which the key member (s) is (are) received in the keyway slot(s) of the at least one hinge adjusts the position of the first structure relative to the second structure across the said opening from the axis in the said plane.

10. First and second structures according to claim 9, wherein said first and second structures respectfully comprise an internal door of a building and a building doorway.

11. First and second structures according to claim 9, wherein said second and first structures respectfully comprise a vehicle and a hingedly openable portion of a vehicle chosen from a vehicle door, a vehicle window, a hatchback, a vehicle boot, a vehicle trunk, a vehicle hatch, a vehicle bonnet and a vehicle roof opening.

12. First and second structures according to claim 9, wherein said second and first structures respectfully comprise a generally box-shaped member selected from a box, a cabinet, a refrigerator and a case, and an openable member therefor selected from a lid and a door.

13. A door hung in a doorway by at least one hinge, the hinge comprising first and second elements, respectively attached to the door and to the doorway, the first and second elements being coupled together so as to be hingedly rotatable about a generally vertical hinge axis relative to each other;

the first said element comprising a first elongate member extending along the direction of the hinge axis and defining a keyway slot therein that extends part way along the said member from one end thereof, and a second member attached to the door and integrally formed with a key member receivable in the slot, the keyway slot and the key member being formed with profiles that enable the key member to be received in the slot to a selected one of a plurality of depths, thereby enabling adjustment in the spacing of the door radially of the said axis, whereby the position of the door is adjustable across the doorway by selecting said depth.

14. A door hung in a doorway as defined in claim 13, wherein the second element of the hinge comprises a second elongate member extending along the direction of the hinge axis, and having a first end and a second end, the second elongate member defining an opening extending at least part way along the said second elongate member from said first end;

wherein the first elongate member is formed with a first generally cylindrical section and with a second section, the said first section being inserted into the opening in the second member to couple the first member and the second member together to form the hinge, and being rotatable about the hinge axis within the said opening, and the second section of the first elongate member being larger in cross-section than the diameter of the first said section to define a land between the first and second sections, the second section having the keyway slot formed therein;

and wherein a number, selected from zero, one and a plurality, of spacing elements selected from spacers and washers is inserted between the said land and the confronting first end of the second elongate member to adjust the height of the door within the doorway along the hinge axis.

15. A door hung in a doorway as defined in claim 13, wherein the second element comprises a threaded member extending radially of the axis, the hinge being attached to the doorway by said threaded member, whereby the position of the door as a whole relative to the doorway may be adjusted horizontally into and out of the doorway by adjusting the depth of threaded attachment between the threaded member and the doorway.

* * * * *